US006086004A

United States Patent [19]

Uchida et al.

[11] Patent Number: 6,086,004

[45] Date of Patent: Jul. 11, 2000

[54] PROCESS FOR MAKING A SPANDEX SUPPLY PACKAGE

[75] Inventors: Takamasa Uchida, Kyoto-fu; Kazue Oka, Shiga-ken, both of Japan

[73] Assignee: DuPont-Torav Company, Ltd., Tokyo, Japan

[21] Appl. No.: 09/131,958

[22] Filed: Aug. 11, 1998

Related U.S. Application Data

[63] Continuation-in-part of application No. 08/737,700, Nov. 20, 1996.

[30] Foreign Application Priority Data

May 24, 1995 [WO] WIPO ..... PCT/US95/06591

[51] Int. Cl.[7] ..... B65H 55/04; B65H 23/18; B65H 59/38; B65H 77/00; B65H 54/42

[52] U.S. Cl. ..... 242/178; 242/412; 242/486.3; 242/486.7

[58] Field of Search ..... 242/486.3, 486.7, 242/412, 174, 159, 178; 28/240

[56] References Cited

U.S. PATENT DOCUMENTS

| | | | |
|---|---|---|---|
| 3,344,597 | 10/1967 | Petree . | |
| 3,940,917 | 3/1976 | Strachan . | |
| 3,987,611 | 10/1976 | Kitamura et al. | 242/486.7 X |

FOREIGN PATENT DOCUMENTS

| | | | |
|---|---|---|---|
| 1585265 | 1/1970 | France . | |
| 51-127229 | 11/1976 | Japan | B65H 55/04 |
| 62-21714 | 5/1987 | Japan | B65H 55/04 |
| 1-226669 | 9/1989 | Japan | B65H 55/04 |

*Primary Examiner*—Donald P. Walsh
*Assistant Examiner*—Collin A. Webb
*Attorney, Agent, or Firm*—George A. Frank

[57] ABSTRACT

A process for preparing a spandex supply package with minimal package relaxation variations along the length of spandex utilizing precalculated variable winding speeds for different segments of the package, calculated from package relaxation values of a reference spandex supply package, and uniform supply packages prepared by this process, are provided.

6 Claims, 2 Drawing Sheets

PROCESS FOR MAKING A SPANDEX SUPPLY PACKAGE

CROSS REFERENCE TO RELATED APPLICATIONS

This application is a continuation-in-part of U.S. patent application Ser. No. 08/737,700 filed Nov. 20, 1996, which was refiled as a continuing patent application on Jun. 1, 1998.

BACKGROUND OF THE INVENTION

1. Field of the Invention

This invention relates to a process for preparing a spandex supply package intended for passive feeding of the spandex to various types of textile equipment and, more specifically, to a process that results in a package that permits improved uniformity of feeding of the spandex.

2. Description of Background Art

Spandex is well known and widely used in the manufacture of knitwear. "Spandex" is a manufactured fiber or filament in which the fiber-forming substance is a long chain synthetic elastomer comprised of at least 85% by weight of a segmented polyurethane. After dry-spinning, spandex is wound on a package (also known as a cake or bobbin) at a predetermined tension. The tension causes the spandex to be in an extended state in the package. The percent package relaxation value, %R, of any segment of the spandex wound in the supply package is a measure of the extension of the spandex in that segment and is defined by equation (I):

$$\%R=100\times[(L_s-L_r)/L_s] \quad \text{(I)}$$

where in any segment of yarn unwound (i.e., removed) from the package, $L_r$ is the relaxed length of the unwound segment, and $L_s$ is the stretched length which the unwound segment had while still wound and under tension in the supply package. %R, $L_r$, and $L_s$, are determined by the "package relaxation value" test described hereinafter. As used herein, "segment" refers to a selected fraction of the length of the spandex in a package.

A spandex supply package is conventionally wound up at a constant windup speed from the start to the end of the winding of the package. As a result of the constant windup speed, the spandex in the package has percent package relaxation values that vary from a large value in the outside layer of the package to a smaller value in the middle layer of the package and then to a larger value again in the inner layer nearest the core of the package. This variation in percent package relaxation can cause uniformity problems in downstream processing.

When fabrics are knit with spandex, the spandex is forwarded from a supply package to a knitting machine by means of an active or a passive feeding device. An active feeding device removes the spandex from the package while the package is rotated by a surface-contacting driven roller or by driven rotation of the tube on which the spandex is wound. A passive feeding device removes the spandex from the supply package by pulling the spandex over one end of the supply package (i.e., "over-end take-off") or by pulling the spandex tangentially from the surface of the supply package while the package is free to rotate on its tubular axis. Passive feeding devices are more economical than active feeding devices. However, when a conventionally prepared spandex supply package is used with a passive feeding device, nonuniform unwinding is often encountered, due to nonuniform package relaxation. In knitting operations, the nonuniform unwinding can cause uneven knitting, variations in fabric size (i.e., dimensions) and fabric of low quality.

A conventional method for decreasing the problems associated with non-uniform unwinding of spandex yarns with passive feeding devices, is disclosed, for example, in Japanese Patents Kokai Sho 51-127229, Kokoku Sho 62-21714, and Kokai Hei 1-226669. In such a method, cylindrical supply packages which were formed by winding up spandex at a constant speed on a tubular core as the spandex emerged from a dry spinning process are completely rewound to form a new package. The rewound spandex supply packages have less tackiness and fewer nonuniformities in subsequent knitting operations. However, rewinding spandex supply packages is time-consuming, labor intensive and expensive. Furthermore, even when such a rewound package is used with passive feeding device, undesirable thread breaks and knit fabric non-uniformities are still encountered, although at a somewhat lower frequency than with conventional spandex supply packages that were not rewound.

U.S. Pat. No. 4,615,495 to Correll discloses low density, substantially cylindrical, wound packages of substantially tensionless elastic yarn prepared by rewinding yarn (a feed yarn) from an existing package of yarn. Correll eliminates friction from the yarn, thereby maintaining a constant velocity of the yarn after leaving the overfeed rolls to obtain a tensionless wound package, by transforming the yarn guide portion of a traverse mechanism into a fluid jet. Such a tensionless package, however, is not stable.

In view of the above-described problems with spandex supply packages, there is a need to provide a process for making an improved spandex supply package that requires no rewinding and provides acceptable passive feeding characteristics.

SUMMARY OF THE INVENTION

The process of the present invention for making a spandex supply package comprises the steps of:

dry-spinning spandex in a shaft;

moving the spandex fiber from an exit of the dry-spinning shaft by at least one feed roll; and winding the spandex onto a cylindrical core at variable winding speeds ($S_x$) to form a spandex supply package comprising a plurality of pre-selected segments x along the length of the fiber, wherein the winding speed $S_x$ for each segment is predetermined from the equation $$S_x=S_o\times(100-\%R_y)/(100-\%R_x)$$

wherein $S_o$ is a constant winding speed at which a reference spandex supply package was wound, $\%R_y$ is the package relaxation value of each pre-selected segment y along the length of the fiber in the reference package corresponding in location along the length of the fiber to the pre-selected segments x in the spandex package formed in this step, and $\%R_x$ is the intended package relaxation value of each segment x in the spandex package formed above; and wherein the spinning conditions for the spandex and the dimensions and weight of the spandex package are substantially the same as those of the reference package.

The product of the present invention is a spandex supply package prepared by the process of this invention.

DETAILED DESCRIPTION OF PREFERRED EMBODIMENTS

Figure 1:
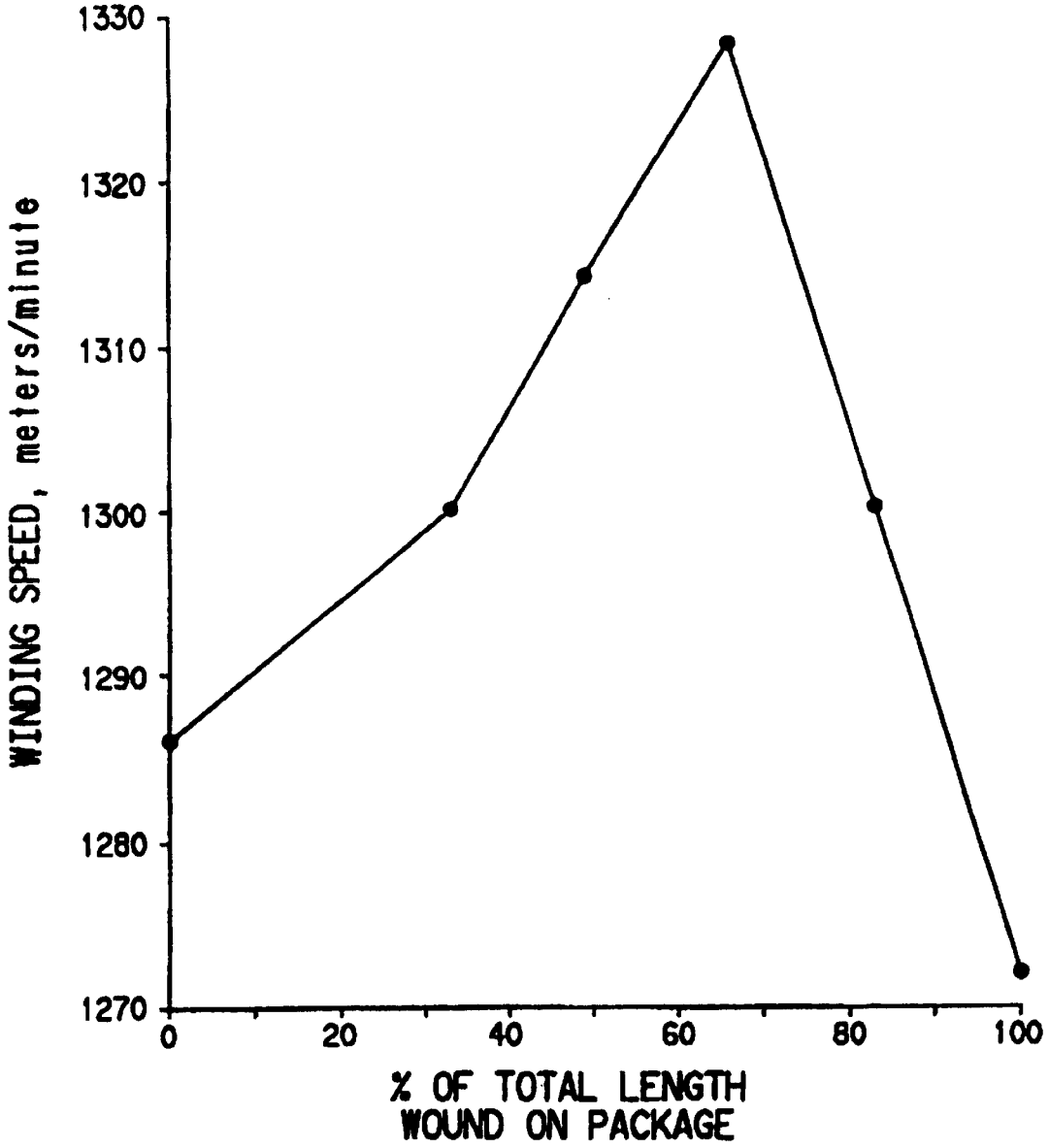
FIG. 1 is a graph of the winding speed as a function of the percent of the total amount of spandex wound in the spandex supply package prepared according to the invention.

In accordance with the process of the present invention, spandex is dry-spun by conventional methods such as by using a spinning shaft and at least one feed roll as illustrated, for example, in U.S. Pat. No. 3,094,374, incorporated herein by reference. The spandex is then wound onto a cylindrical core rotatably mounted on a windup to form a spandex supply package. In the process of the present invention, the windup speed $S_x$ is varied for predetermined segments x along the length of the spandex being wound into the package. To accomplish this, a drive roll of the windup (if the latter is surface-driven) or the drive shaft of the windup (if the latter is spindle-driven) is powered by a variable speed electric motor whose speed is adjusted for each segment.

The winding speed $S_x$ for each segment x of a spandex package to be formed is predetermined from equation (II):

$$S_x = S_0 \times (100 - \%R_y)/(100 - \%R_x) \quad \text{(II)}$$

wherein $S_0$ is a constant winding speed at which a reference spandex supply package has been wound up;

$\%R_y$ is the percent package relaxation value of each pre-selected segment y along the length of the fiber in a reference spandex package (not made by the process of the invention) corresponding in location along the length of the fiber to the pre-selected segments x of the package to be formed; and $\%R_x$ is the intended percent package relaxation value of each segment x of the spandex package to be formed.

The spinning conditions for the spandex and the package dimension and the package weight of the package of this invention are substantially the same as those of the reference package to allow the process of this invention to perform well. Also, preferably, the composition of the two spandex fibers have the same composition.

The package relaxation values ($\%R_y$) of sampled segments y of the conventionally wound reference supply package can be determined as described below. The spandex of this package can be, but does not need to be, of the same composition and made at the same, substantially constant, feed roll speed as utilized to form the supply package made by the process of this invention. In contrast to the process of this invention, however, the reference supply package is wound at a constant windup speed from the starting point to the ending point of the package.

Any value between the maximum and minimum percent package relaxation values of the reference package can be used for the intended percent package relaxation value ($\%R_x$) of the spandex supply package of the invention. To determine the maximum and minimum percent package relaxation values in any given supply package, such as the reference package, the whole length of the wound up spandex in the package can be divided into three or more segments and the largest value of the average %R values in the segments is designated the maximum %R and the smallest average %R for any segment is designated the minimum %R. The number of the segments used in a supply package for this determination of maximum and minimum %R must be at least three, preferably five or more. However, no matter how many segments are used, the outer, the middle and the inner segments need to be sampled for this determination, because the %R is always larger in the outer and inner segments and smaller in the middle segment.

Typically, the desired (intended) percent package relaxation value is in the range of about 1 to 10%, preferably in the range of about 4 to 8%. For example, when the total length of the spandex of a reference supply package, prepared by a method of the prior art in which the spandex was wound up at a constant speed, was divided into six substantially equal segments and the average percent package relaxation values of each segment were determined, it was found that the %R of the first segment at the outside of the package was 9%; of the second segment, 7%; of the third segment 5%; of the fourth segment 6%; of the fifth segment, 7%; and of the sixth (innermost) segment, 8%. Thus the maximum %R was 9% and the minimum %R was 5%, or a difference of 4 percentage units, an undesirably large variation of package relaxation values along the length of the spandex.

For the process of this invention, the spandex to be wound onto the first supply package is divided into same number of segments as was the case for the reference spandex supply package, and the winding speed $S_x$ for each segment in the package of this invention is calculated based on the location of the segment in the package. The segments within a package can be of equal or unequal length, but the length of each segment in the spandex package to be prepared by the process of this invention must be substantially equal to the length of the corresponding segment in the reference supply package to obtain a final package with minimal package relaxation variations along the length of the spandex. For example, in the illustration given above, the reference spandex supply package was divided into six equal segments having maximum and minimum percent package relaxation values of 9 and 5%, respectively. Thus, a suitable desired package relaxation value for the supply package of the invention could be set at 7% (i.e., selected to be between the maximum and minimum values of the conventional package). Then, by use of equation II above, the desired windup speed for each corresponding segment of the spandex supply package of the invention ($S_x$) can be calculated. In the illustration given above, this results in calculated windup speeds during the winding of the first and sixth segments of the supply package of the invention being decreased compared to the windup speed ($S_o$) used to prepare the reference spandex supply package. The calculated windup speeds for the second and fifth segments of the supply package of the invention are calculated to be the same as the windup speed of the reference spandex supply package, while the calculated winding speeds for the third and fourth segments of the supply package of the invention are, by necessity, higher than the windup speeds of the reference package. It is preferred that there be a smooth transition in proceeding from the windup speed of one segment to another speed for the next segment.

The spandex supply package resulting from the process of the present invention has maximum and minimum percent package relaxation values that differ by no more than 2% and preferably by no more than 1.5%. As a result, the spandex supply package of the invention does not require rewinding.

When a spandex supply package of the invention is used in a knitting process with a passive feeding apparatus, more stable knitting, fewer spandex breaks and a more even, consistent knit fabric size can be obtained when compared to that obtained from conventional spandex supply packages, including conventional packages that had been rewound.

The spandex used in the process and product of the present invention can contain additives which are included for various purposes. Among typical suitable additives are hindered amines, hindered phenols, UV absorbents, tertiary amines, gas discoloration inhibitors, metal soaps such as metal stearates, pigments such as titanium dioxide, and the like. The spandex is typically dry spun from solution of the polymer in an inert organic solvent (e.g., dimethyl acetamide) through spinnerets into a spin shaft heated with gas. The surface of the dry-spun filaments can be coated with an oiling agent. A typical oiling agent contains as a major component, an organopolysiloxane such as dimethylpolysiloxane or polysiloxanes modified with amino groups or hydroxyl groups. The amount of oiling agent coated is 1–20wt %, preferably 3–15wt %, more preferably 4–12wt %, based on the weight of the fiber.

Figure 2:
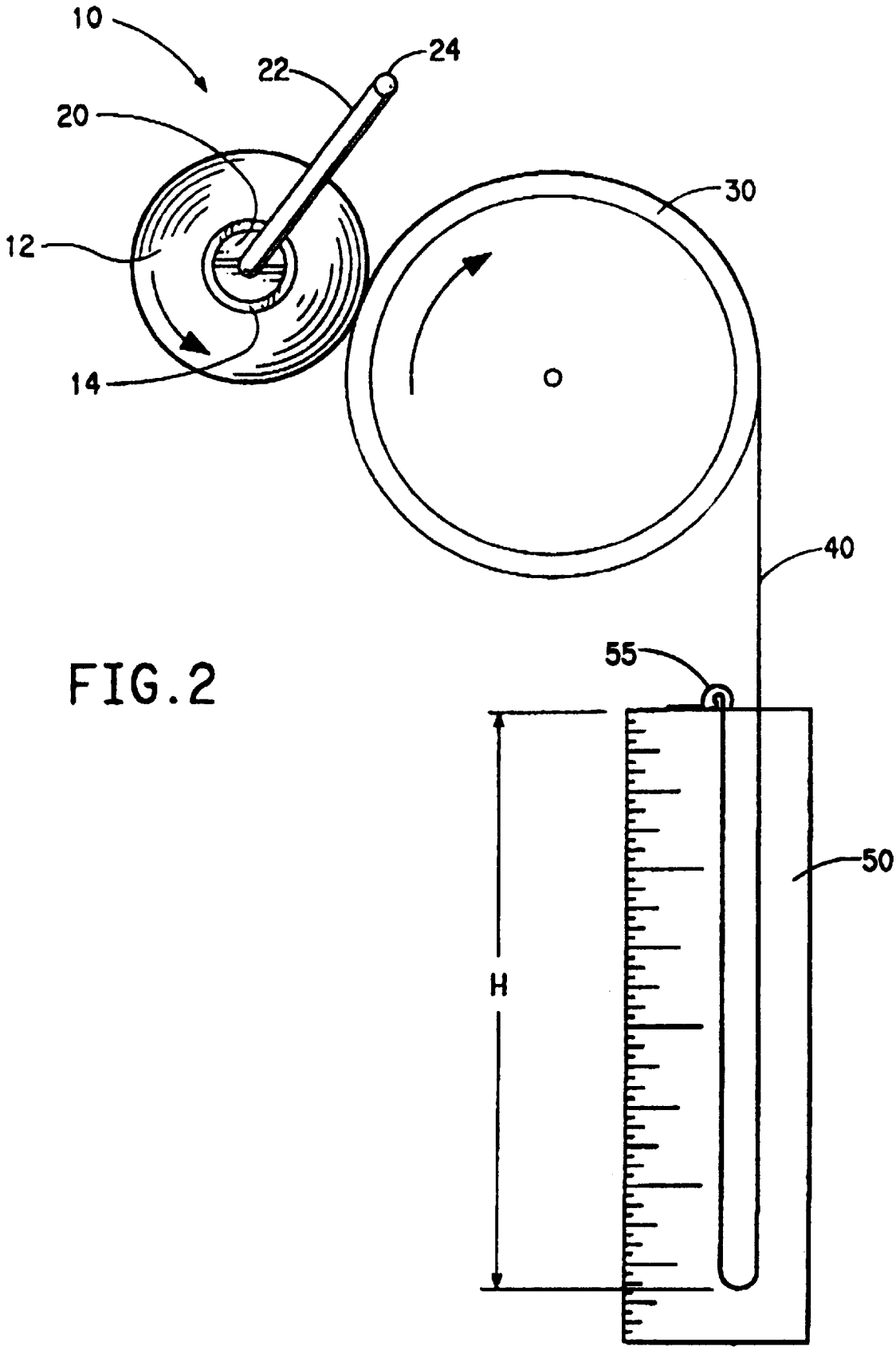
FIG. 2 is a schematic side view of the apparatus used to measure percent package relaxation values.

Percent package relaxation values (%R) were determined using the apparatus depicted in FIG. 2, and %R was then calculated from the test results by application of equation I. FIG. 2 shows a sample spandex supply package 10, comprising spandex 12 wound on tube 14 which is mounted on package holder 20. The package holder was rotatable by crank 22 with handle 24. The surface of package 10 was contacted by the surface of roll 30 which permitted a specimen length 40 of spandex to be forwarded to a scale 50. The end of specimen 40 was held with clip 55 at a zero point on scale 50. At the start of the measurement, only enough spandex was forwarded from the supply package to permit the end of the specimen to be precisely positioned at the zero point of the scale. The scale can be moved up or down to adjust the position of the zero point. Then by rotating the crank, spandex can be released from the package without any tension. The released spandex formed a narrow U-shaped loop hanging on the scale. The length of the loop (2H, in FIG. 2) was of insufficient weight to cause sagging of the loop and no tension is applied to the loop. The number of rotations N of the spandex package, the length H, and the outer diameter $D_z$ of the spandex package during the determination of the package relaxation of segment z (which can be segment x of the package of the invention or segment y of the reference package) were precisely measured. Then, $L_s$ (the stretched length that the unwound segment had while it was still wound in the package), $L_r$ (the relaxed length of the unwound segment) and %R (the percentage package relaxation value) were calculated from equations III and IV below and from equation I:

$$L_r = 2H \quad \text{(III)}$$

$$L_s = \pi D_z N \quad \text{(IV)}$$

$$\%R = 100 \times [(L_s - L_r)/L_s] \quad \text{(I)}$$

For measuring waistband size, a panty hose waistband was knitted with a Nagata KTS-4 knitting machine. The knitting was carried out at a rate of 545 rpm using four feed yam inlets, with a 30-denier (33-dtex) nylon thread and a spandex being fed to the first inlet, 30-den nylon threads being fed to the second and third inlets and a 15-den (17-dtex) nylon thread being fed to the fourth outlet. The pantyhose waistband was set at 35 cm in the circular knitting. Waistband size was the measured width of the relaxed circular knit waistband after the waistband was released from tension.

EXAMPLE

A 12-filament and 140-denier (160-dtex) spandex yarn was prepared by extruding through spinnerets, at the rate of 500 grams/hour, a solution of a polyetherurethaneurea polymer in N,N-dimethylacetamide into a nitrogen atmosphere of a spin shaft that heated the nitrogen gas at 430° C. The polymer was made by reacting poly(tetramethyleneether) diol with 4,4-diphenylmethane diisocyanate to form an isocyanatecapped prepolymer that was chain extended with ethylenediamine. A lubricating agent containing dimethylpolysiloxane as the major component was applied to the surface of the spandex. The lubricating agent was 7.5% of the total weight of the spandex.

A conventional bobbin of the thusly prepared spandex yam was then wound up with a constant winding speed of 1300 m/min on a core tube of 5-cm diameter at a helix angle of 17 degrees to form a supply package with an outer diameter of 17 cm. The spandex wound on the conventional bobbin was divided into five equal segments and the percent package relaxation value of each segment was measured. The maximum and the minimum package relaxation values were 10.9% and 6.8%, respectively.

A desired percent package relaxation value for the preparation of corresponding spandex supply bobbins was set according to the invention at 7.0%, a value that was between the maximum and the minimum values of the percent package relaxation values of the conventional spandex bobbin. Then, with the desired 7% relaxation value for the spandex supply package of the invention, and the %R values measured for the various segments of the corresponding conventionally prepared spandex supply package wound up at the constant windup speed, $S_0$, of 1,300 meters per minute, the following windup speeds were calculated by equation II and set for the preparation of the spandex supply packages of the invention. The windup speeds for each package were changed in five stages, each stage corresponding to each of the five segments of the conventional package and of the package to be made according to the process of the invention. Table I summarizes the amounts of spandex wound on the bobbin during each windup stage, from the beginning of the winding to the end of the winding of the bobbin, and FIG. 1 shows the windup speed changes graphically.

TABLE 1

| Cumulative % of total spandex wound on bobbin | Windup speed meters/min |
|---|---|
| 0 | 1,286 |
| 32 | 1,300 |
| 49 | 1,314 |
| 66 | 1,328 |
| 83 | 1,300 |
| 100 | 1,272 |

The 0% wound corresponds to the innermost segment of the spandex wound on the bobbin. The 100% wound corresponds to the outermost segment of the spandex wound on the bobbin.

The percent package relaxation values, $\%R_x$, of the various segments of the wound-up spandex supply bobbins of the invention made in this example and the results of pantyhose waistband knitting tests with the spandex from the bobbins are compared in Table 2 to the $\%R_y$ values and waist band knitting results obtained with corresponding segments from rewound conventional spandex supply packages.

TABLE 2

| Amount | Package of invention | | Rewound conventional package | |
|---|---|---|---|---|
| wound, % | % $R_x$ | Size*, cm | % $R_y$ | Size*, cm |
| 100 | 7.6 | 10.5 | 6.8 | 11.0 |
| 83 | 7.3 | 10.9 | 5.1 | 11.1 |
| 66 | 7.0 | 11.1 | 4.0 | 11.2 |
| 49 | 6.9 | 11.1 | 3.5 | 11.1 |
| 32 | 6.7 | 11.0 | 4.5 | 11.2 |
| 15 | 6.3 | 11.1 | 6.5 | 11.1 |

*Note: Size refers to relaxed width of knit waistband

As shown in Table 2, the difference between the maximum and minimum package relaxation values in the spandex supply packages of the invention was 1.3%. In contrast, the corresponding difference was 3.3% in the spandex of the rewound conventional spandex supply packages. Note that the size variation in the width of the knit waistbands prepared with spandex supply packages according to the invention was 0.6 cm. Although this value was larger than the 0.2-cm size variation of waistbands that were knit with the conventional rewound spandex supply bobbins, for practical use, the allowed size variation in such waistbands is usually within 1 cm. Therefore, the variation in size exhibited by waistbands made with supply packages of the invention will not cause any problems.

A 14-day continuous knitting test with five Nagata KTS-4 knitting machines was then performed to compare the efficiency of producing knit pantyhose with of spandex passively fed from the supply bobbins prepared according to the invention versus from rewound conventionally prepared supply bobbins. In the knitting test the number of thread breaks per knitting machine per day were recorded as a measure of production efficiency. The frequency of breaks with spandex supplied from the conventional rewound bobbins (0.80 breaks per machine per day) was 20 times greater than that experienced with spandex supplied from bobbins prepared according to the invention (0.04 breaks per machine per day).

This example shows the advantages of the spandex supply packages of the invention over conventionally prepared, rewound supply packages of the same spandex. The supply packages of the invention had a lower range of package relaxation values and in a 14-day knitting test exhibited a broken thread rate that was one-twentieth the broken thread rate experienced with the rewound conventional spandex supply packages.

What is claimed is:

1. A process for making a spandex supply package comprising the steps of:

dry-spinning spandex in a shaft;

moving the spandex fiber from an exit of the dry-spinning shaft by at least one feed roll; and winding the spandex onto a cylindrical core at variable winding speeds ($S_x$) to form a spandex supply package comprising a plurality of pre-selected segments x along the length of the fiber, wherein the winding speed $S_x$ for each segment is predetermined from the equation $$S_x = S_o \times (100 - \%R_y)/(100 - \%R_x)$$

wherein $S_o$ is a constant winding speed at which a reference spandex supply package was wound, $\%R_y$ is the package relaxation value of each pre-selected segment y along the length of the fiber in the reference package corresponding in location along the length of the fiber to the pre-selected segments x in the spandex package formed in this step, and $\%R_x$ is the intended package relaxation value of each segment x in the spandex package formed above; and wherein the spinning conditions for the spandex and the dimensions and weight of the spandex package are substantially the same as those of the reference package.

2. The process of claim 1 wherein the spandex of the reference package has the same composition as the spandex package prepared by the process.

3. The process of claim 2 wherein $R_x$ is approximately 1–10% and the number of segments is at least three.

4. The process of claim 1 wherein the number of segments is at least five.

5. A spandex supply package prepared by a process comprising the steps of:

dry-spinning spandex in a shaft;

moving the spandex fiber from an exit of the dry-spinning shaft by at least one feed roll; and winding the spandex onto a cylindrical core at variable winding speeds ($S_x$) to form a spandex supply package comprising a plurality of pre-selected segments x along the length of the fiber, wherein the winding speed $S_x$ for each segment is predetermined from the equation $$S_x = S_o \times (100 - \%R_y)/(100 - \%R_x)$$

wherein $S_o$ is a constant winding speed at which a reference spandex supply package was wound, $\%R_y$ is the package relaxation value of each pre-selected segment y along the length of the fiber in the reference package corresponding in location along the length of the fiber to the pre-selected segments x in the spandex package formed in this step, and $\%R_x$ is the intended package relaxation value of each segment x in the spandex package formed above; and wherein the spinning conditions for the spandex and the dimensions and weight of the spandex package are substantially the same as those of the reference package; and wherein the maximum percent package relaxation value and a minimum percent package relaxation value differ by no more than 2%.

6. The spandex supply package of claim 5 wherein the maximum percent package relaxation value and the minimum percent package relaxation value differ by no more than 1.5%.

* * * * *